US006848640B2

(12) United States Patent
Pallmann

(10) Patent No.: US 6,848,640 B2
(45) Date of Patent: Feb. 1, 2005

(54) DEVICE FOR COMMINUTING MATERIAL AND KNIFE SUPPORT PLATE

(75) Inventor: Wilhelm Pallmann, Zweibrücken (DE)

(73) Assignee: Pallmann Maschinenfabrik GmbH & Co. KG, Zweibrücken (DE)

( * ) Notice: Subject to any disclaimer, the term of this patent is extended or adjusted under 35 U.S.C. 154(b) by 171 days.

(21) Appl. No.: 10/233,285

(22) Filed: Aug. 30, 2002

(65) Prior Publication Data

US 2003/0042346 A1 Mar. 6, 2003

(30) Foreign Application Priority Data

Sep. 4, 2001 (DE) ..... 101 43 184

(51) Int. Cl.[7] ..... B02C 18/18
(52) U.S. Cl. ..... 241/292.1; 144/174; 241/294
(58) Field of Search ..... 144/172, 174; 241/292.1, 293, 294, 300

(56) References Cited

U.S. PATENT DOCUMENTS 2,829,695 A * 4/1958 Jarvis ..... 241/227
5,660,218 A * 8/1997 Jonkka ..... 144/176

* cited by examiner

*Primary Examiner*—Lowell A. Larson
(74) *Attorney, Agent, or Firm*—Friedrich Kueffner

(57) ABSTRACT

A device for comminuting material includes a plurality of knife carriers arranged along a comminuting path, wherein each knife carrier has a receiving unit with a stop for a knife bundle. The knife bundle is held in a position of operation in the receiving unit, wherein each knife bundle is composed of a knife support plate and a chipping knife. The knife support plate and the chipping knife are connected to each other so as to overlap in a transverse direction in a plane of the knife support plate. The knife support plate has at a longitudinal side thereof facing the stop of the knife carrier at least one stop surface, wherein the stop surface is adjustable in the transverse direction of the knife support plate.

11 Claims, 5 Drawing Sheets

DEVICE FOR COMMINUTING MATERIAL AND KNIFE SUPPORT PLATE

BACKGROUND OF THE INVENTION

1. Field of the Invention

The present invention relates to a device for comminuting material. The device includes a plurality of knife carriers arranged along a comminuting path, wherein each knife carrier includes a receiving means with stop for a knife bundle, and wherein the knife bundle is supported in the receiving means in an operating position. Each knife bundle includes a knife support plate and a chipping knife, wherein the knife support plate and the chipping knife are connected to each other in the plane of the knife support plate so as to overlap in the transverse direction of the plate. The present invention also relates to a knife support plate.

2. Description of the Related Art

Devices of the above-described type are known in the art in the form of, for example, knife ring chippers or also disc chippers. A knife ring chipper has as its comminuting unit a knife ring which is freely rotatable about an axis and which is composed essentially of two concentric annular discs which are connected to each other through knife carriers which are arranged in the shape of a ring. Consequently, the inner circumferential surface of the knife ring is formed by the bottom sides of the knife carriers and simultaneously forms the surface which defines the comminuting space. Because it is subjected to high mechanical loads, this surface is constructed so as to be resistant to wear.

The individual knife carriers are arranged at a predetermined relative distance from each other, so that they form longitudinal gaps over the width of the inner circumferential surface of the knife ring. In this area, the knife carriers have special receiving units for receiving a knife bundle each. The knife bundles are composed of a chipping knife and a knife support plate which are adjustably and releasably connected to each other through oblong holes and screws. In the assembled state, the chipping knives of the knife bundles project through the remaining longitudinal gaps between the knife carriers beyond the inner circumferential surface into the comminuting space. The projecting lengths of the cutting edges determines the thickness of the chips to be manufactured. In this manner, the circumferential surface of the knife ring forms together with the cutting edges of the chipping knives a drum-shaped comminuting path of a knife ring chipper.

A prerequisite for a high-quality comminution of the material is that the cutting edges of a knife ring are arranged on a common trajectory circle with identical projecting lengths of the cutting edges. For ensuring this, each knife carrier has a fixedly defined stop which determines the so called zero position of the knife bundles. The zero positions of all knife carriers of a knife ring constitute reference surfaces for the assembly of the knife bundles which all have the same radial distance from the axis of rotation of the knife ring. Starting from these reference surfaces, it is possible to determine the state of wear of the knife carriers uniformly for the entire knife ring and to adjust the required projecting lengths of the cutting edges of the chipping knives. In known knife ring chippers, the stop defining the zero position is formed by the inner defining surface of the recesses for the knife bundles of each knife carrier.

A knife ring chipper is subjected to natural wear during operation. Especially the inner circumferential surface of the knife ring, including the knife support plates and the chipping knives, are affected to a significant extent. Because of the different material properties, the arrangement and operation in the comminuting space and the duration of use, the aforementioned components have different degrees of wear.

The chipping knife carriers out the actual comminuting work and its projecting length of the cutting edge is subjected to great loads. Consequently, this is where high wear phenomena occur, so that the chipping knives must be resharpened in regular intervals of about four hours, wherein each sharpening procedure shortens the chipping knife transversely of its longitudinal direction. The knife support plates form with one of their longitudinal sides a portion of the inner circumferential surface of the knife ring. Since they are arranged directly behind the chipping knives in the circumferential direction, the wear phenomena are not as significant. In addition, since several sets of knife support plates are kept available, the period of use of the knife holding plates is already short. While the inner circumferential surface of the knife ring formed by the bottom sides of the knife carriers is constructed so as to be resistant to wear, it still has a gradual wear in the order of magnitude of a few millimeters per year. This shortens the distance between the zero position and the inner circumferential surface of the knife ring.

The different wear behavior of the parts which are subject to wear during the operation of a comminuting machine have over time the effect that the internal diameter of a knife ring is increased, wherein the knife support plates which are subject to slower wear protrude beyond the circumferential surface of the knife ring. In practical operation, this is corrected by grinding down the respective longitudinal side of each knife support plate, so that, however, the width of the knife support plates is shortened.

Problems always occur if knife carriers whose bottom sides are worn are replaced by new knife carriers and if simultaneously used or ground knife support plates are used. In that case, a groove-like indentation occurs in the area of the knife support plate relative to the remaining inner circumferential surface of the knife ring, wherein the indentation forms together with the knife carrier a sharp longitudinal edge. The material to be comminuted is additionally comminuted to an undesired extent at this longitudinal edge and the content of fine material in the final product is increased, so that the quality of the final product decreases. Therefore, it is necessary that when the operator of such a comminuting machine replaces the knife carrier the knife support plates must also be replaced which significantly increases the operating costs.

SUMMARY OF THE INVENTION

Therefore, it is the primary object of the present invention to provide a possibility for using the knife support plates of a knife bundle independently of the state of wear of the knife carrier of a knife ring.

In accordance with the present invention, in a device of the above-described type, each knife support plate has at its longitudinal side facing the stop of the knife carrier at least one adjustable stop surface extending in the transverse direction of the knife support plate.

The basic concept of the invention resides in making the width of a knife support plate variable. This makes it possible to adjust the knife support plate to the state of wear of the knife carrier independently of the required projecting length of the cutting edges. In accordance with the present invention, this is made possible by providing a knife support plate with an adjustable stop surface at its longitudinal side facing the stop of the knife carrier.

As a result of the configuration according to the present invention, it is possible to use knife support plates independently of the respective state of wear of the knife carriers or even of the knife support plates themselves. When knife carriers are worn it is no longer necessary to grind down the front longitudinal side of the knife support plate. Also, it is no longer necessary to replace the knife support plates when the knife carriers are replaced. This increases the service life of the knife support plates significantly and substantially reduces the costs.

Knife support plates according to the present invention can be used in existing comminuting devices without requiring retrofitting measures. This significantly reduces the costs for the operator of comminuting devices which are to be redesigned to use the system proposed according to the invention.

In a simple and simultaneously inexpensive embodiment of the invention, threaded bolts are used, wherein the heads of the threaded bolts form the stop surfaces. In accordance with this embodiment, the distance between the head of the threaded bolt from the remaining knife support plate is infinitely variably adjustable and can be secured by means of a counter nut or an adhesive.

In accordance with another embodiment of the invention, one or more stop blocks are provided at the rear longitudinal side of the knife support plate. The stop blocks are fastened, for example, by means of screws, wherein the required distance can be adjusted almost infinitely variable to the desired value by using spacer discs.

In accordance with a further development of this embodiment, the rear longitudinal side of the knife support plate has recesses in which the stop blocks are arranged. The recesses form guides for the stop blocks and provide a secure support at the knife support plate.

In accordance with another advantageous feature, the edges of the stop blocks are chamfered. This makes it easier to insert the knife bundles into the recesses in the knife carrier and facilitates sliding of the knife bundles along the stop defining the zero position.

In accordance with another embodiment of the invention, the stop surface is produced through stop plates which, through oblong holes and a mutual screw connection to the knife support plate, permit an infinitely variable adjustment of the total width of the knife support plate and, thus, facilitate an adjustment of the knife support plate to the existing geometric conditions. The thickness of the knife support plate and of the stop plate in the overlapping area may be reduced in such a way that the overlapping area and the residual area of the knife support plate have the same thickness. This significantly simplifies the construction of the knife carrier.

In accordance with a further development of the invention, the knife support plate forms together with its support surface a toothing with the stop of the knife carrier. In this manner, a precision guiding unit of the knife bundle is formed at the knife carrier which ensures the desired position after the knife bundle has been inserted. Moreover, this prevents the knife bundles from dropping out undesirably after the clamping connection to the knife carrier has been loosened.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
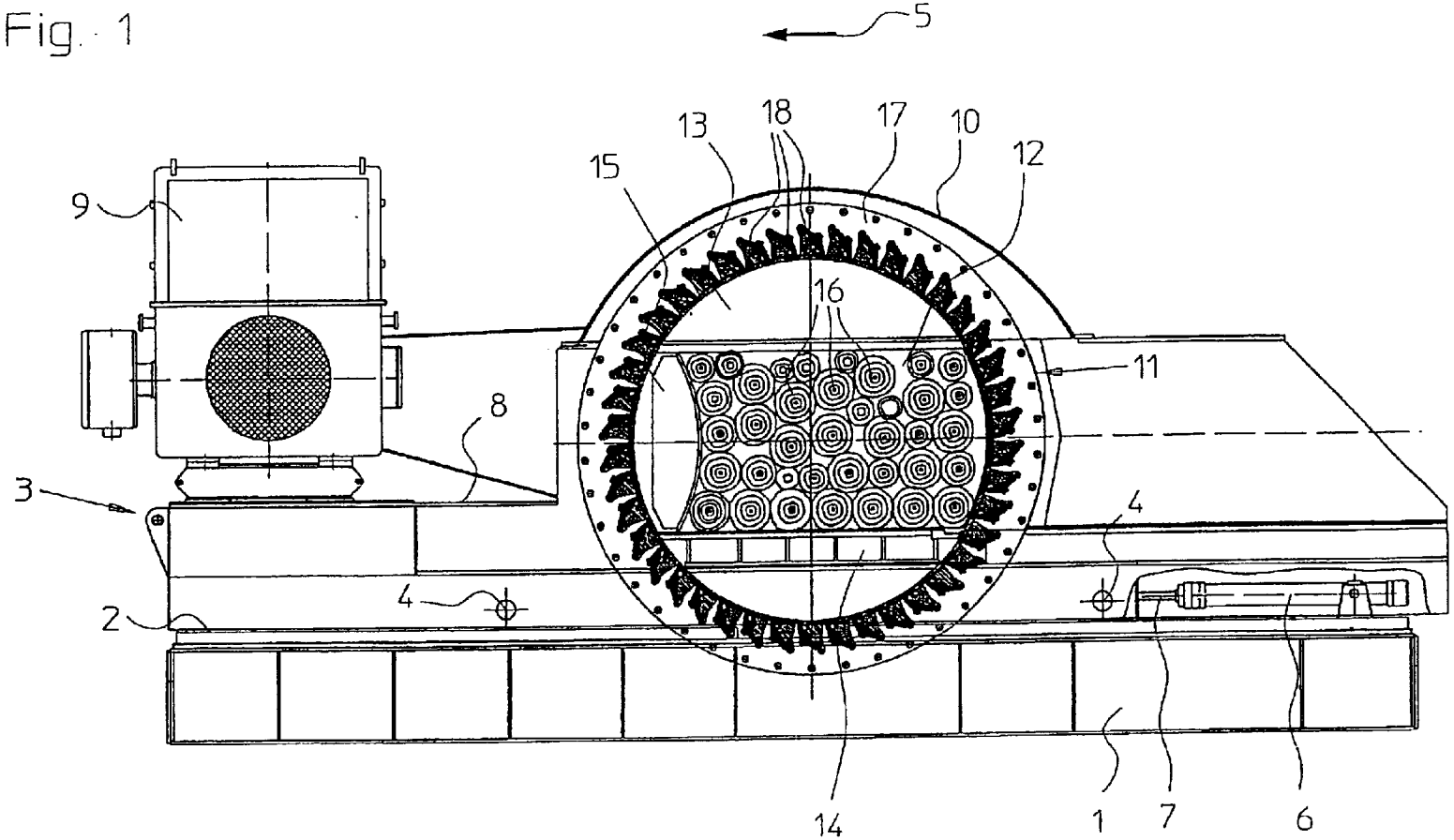
FIG. 1 is a vertical longitudinal sectional view of the device according to the present invention.

FIG. 1 of the drawing shows a knife ring chipper according to the present invention in the form of a long timber chipper. FIG. 1 shows a stationary substructure 1 with rails 2 extending in the plane of the drawing arranged on the upper side of the substructure 1. The rails 2 serve for allowing travel of the machine base frame 3 which is arranged so as to be transversely movable on the wheels 4 in the direction of arrow 5. Fixedly connected to the substructure 1 is a cylinder/piston unit 6 whose movable piston 7 acts on the machine base frame 3 and effects the transverse movement of the machine base frame 3 in this manner. The machine base frame 3 additionally has a platform 8 on which an electric motor 9 is supported.

Also mounted on the machine base frame 3 is a hood-shaped housing 10 which houses a knife ring 11 which is freely rotatable about a horizontal axis. The rear wall of the housing 10 is closed and serves for supporting the drive shaft of the knife ring 11, and the front side of the housing 10 has a circular opening through which the comminuting space 12 is freely accessible. The comminuting space 12 is defined toward the top by a circular arc segment 13 whose curved side extends at a small distance from the knife ring 11. The lower area of the comminuting space 12 is defined by a reinforcing bottom structure 14, wherein the circular arc segment 13 as well as the bottom structure 14 are connected stationary to the housing 10. The surface defining the left side of the comminuting space 12 as seen in the drawing is formed by a counter support 15 which has a convex cross section and extends axially into the comminuting space 12. The counter support 15 is arranged stationary relative to the machine substructure 1 and, thus, does not follow the transverse movement of the machine base frame 3. Finally, the opposite side of the comminuting space 12 is formed by a portion of the inner side of the knife ring 11 and simultaneously constitutes the comminuting path.

The material to be comminuted in the form of logs 16 and the counter support 15 extend with the free portions of their lengths axially into the comminuting space 12. The portion of the logs 16 located outside of the comminuting space 12 is located in a feeding device, not shown, at the end of which the logs are secured for effecting the chipping procedure. Additionally provided in the comminuting space 12 are holding-down devices, not shown, which hold the logs 16 in the comminuting space 12 during the chipping procedure.

The logs 16 are comminuted by transversely moving the machine base frame 3 while the knife ring 11 rotates, wherein the logs 16 are pressed because of the stationary counter support 15 against the comminuting path and are placed in engagement with the comminuting tools.

The knife ring 11 is composed of two concentric annular discs which are arranged at a distance from each other. In the sectional views of FIGS. 1 and 2, only the rear annular disc 17 is visible. The inner sides of the two annular discs are connected through axially directed knife carriers 18 which are uniformly distributed over the circumference, so that a stiff knife ring 11 is formed.

Figure 2:
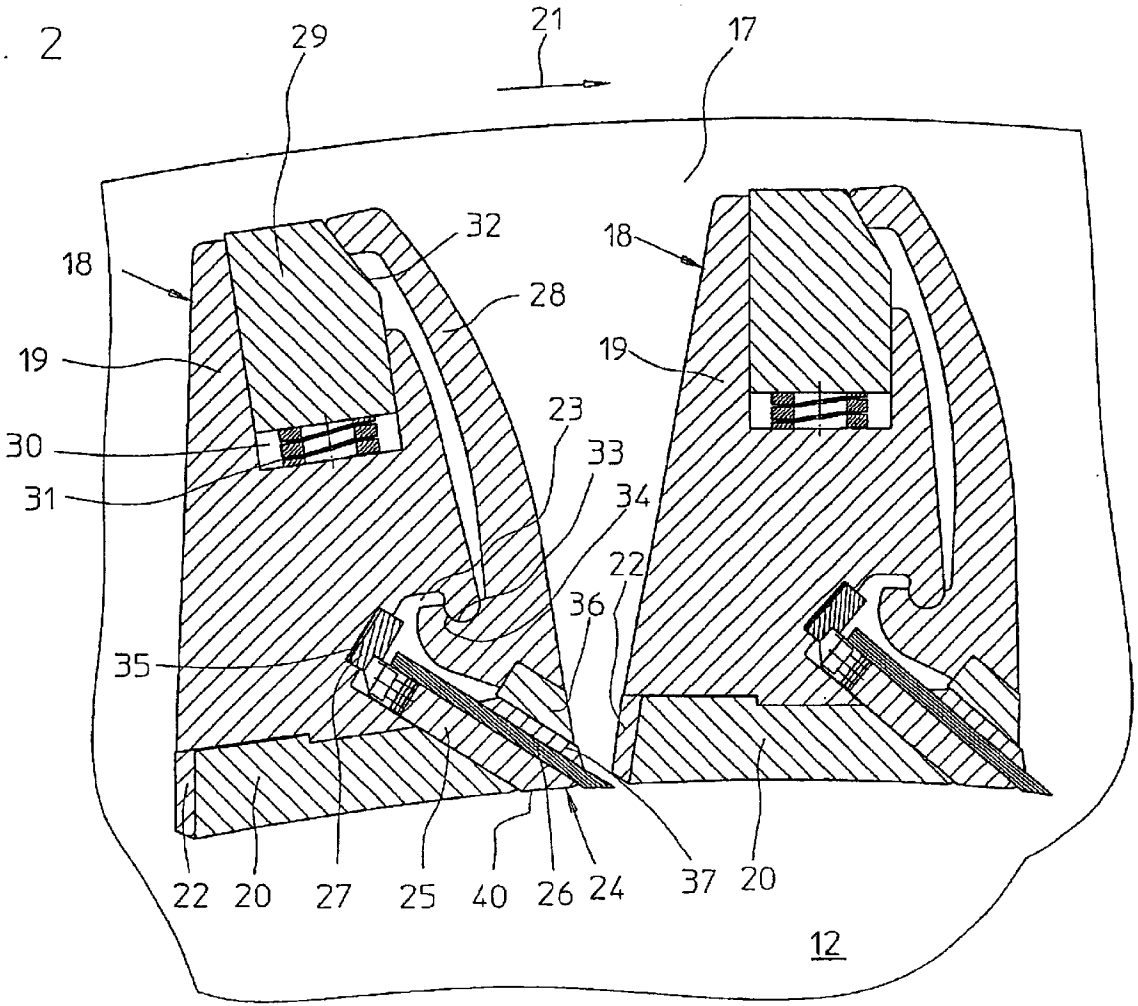
FIG. 2 is a partial sectional view of a knife ring in the area of the knife carrier.

The more precise arrangement of the knife carriers 18 relative to each other and in relation to the annular discs, as well as the construction of the knife carriers 18, are seen in FIG. 2.

FIG. 2 shows a portion of the knife ring 11 according to the present invention. Reference numeral 17 once again designates the annular disc on the side of the hub, wherein the knife carriers 18 project perpendicularly from the inner side of the disc. Each knife carrier 18 essentially is composed of a base carrier 19 which on its bottom side facing the comminuting space 12 is provided with a wear shoe 20. Each wear shoe 20 is provided at its rearward end in travel direction 21 with a pressure lip 22.

Figure 3A:
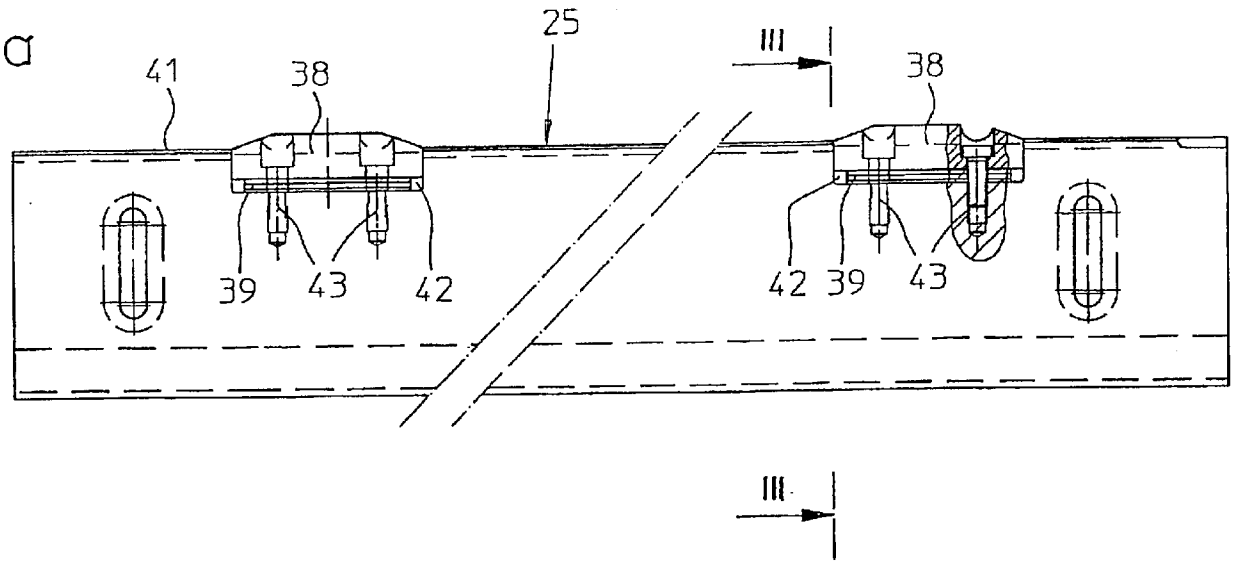
FIG. 3*a* is a top view of the knife support plate of FIG. 2.

Each knife carrier 18 has at its front side in travel direction 21 a recess 23 which extends obliquely into the comminuting space 12. The recess 23 serves to receive a knife bundle 24 and a stop ledge 27 is arranged in the bottom of the recess 23. The knife bundle 24 is formed by a knife support plate 25 on which the chipping knife 26 is fastened in the conventional manner so as to be adjustable within oblong holes. The longitudinal side 41 of the knife support plate 25 facing the stop ledge 27 has two stop blocks 38 which are screwed to the knife support plate 25 with several spacer discs 39 provided therebetween, as illustrated in FIG. 3*a*.

When the knife bundle 24 is inserted into the recess 23, the stop blocks 38 rest against the stop ledge 27 which as a fixed reference surface defines the so called zero position and from which the projecting length of the cutting edge is adjusted. For adjusting the zero position, one or more intermediate layers 35 can be arranged between the stop ledge 27 and the base carrier 19.

For fastening the knife bundle 24 in the recess 23, a frictionally engaging clamping connection is produced by means of a pressure flap 28. The clamping force exerted by the pressure flap 28 against the knife bundles 24 is produced by a ledge-shaped centrifugal wedge 29 which extends over almost the entire axial length of the base carrier 19 and is radially movably guided in a guide groove 30 which is provided in the base carrier 19 and has parallel side walls. A compression spring 31 is arranged between the bottom of the guide groove 30 and the centrifugal wedge 29, wherein the spring force of the compression spring 31 presses the centrifugal wedge 29 permanently outwardly.

The centrifugal wedge 29 has outside of the guide groove 30 a unilateral wedge surface 32, wherein the pressure flap 28 rests with a sliding surface against the wedge surface 32. The pressure flap 28 is provided on its inner side with a groove 33 which is engaged by a hinge ledge 34 provided at the base carrier 19. A clamping ledge 36 is provided at the other end of the pressure flap 28, wherein the clamping ledge 36 together with a pressing element 37 presses over a wide area against the back of the chipping knife 26 and secures the knife bundle 24 in the recess 23 of the knife carrier 18 during rotation of the knife ring 11.

Figure 3B:
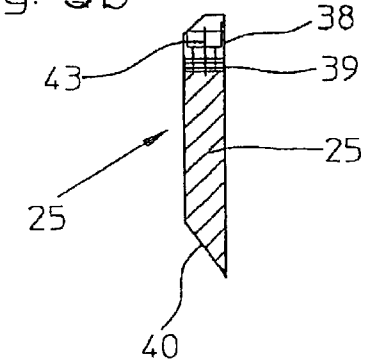
FIG. 3*b* is a sectional view of the knife support plate of FIG. 3*a* taken along sectional line III—III.

FIGS. 3*a* and 3*b* show the knife support plate 25 of FIG. 2 in more detail. The knife support plate 25 whose length is adapted to the dimensions of the base carrier 19, has an inclined surface 40 at its front longitudinal side facing the comminuting space 12, wherein, in the assembled state, the inclined surface 40 is a continuation of the wear shoe 20, as seen in FIG. 2.

Two rectangular recesses 42 are provided in the oppositely located rearward longitudinal side 41, wherein two threaded bores are provided in the bottom of each recess 42. Placed in each recess 42 is a stop block 38 which is braced by means of screws 43 against the bottom of the respective recess 42. By means of spacer discs 39 placed between the stop block 38 and the bottom of the recess 42, the distance between the knife support plate 25 and the stop block 38 can be adjusted to the required dimension.

The upper side of the stop block 38 protruding from the longitudinal side 41 has chamfered edges at three sides thereof. The surface defined by the chamfered edges forms the stop surface relative to the stop ledge 27 of the knife carrier 18.

Figure 4:
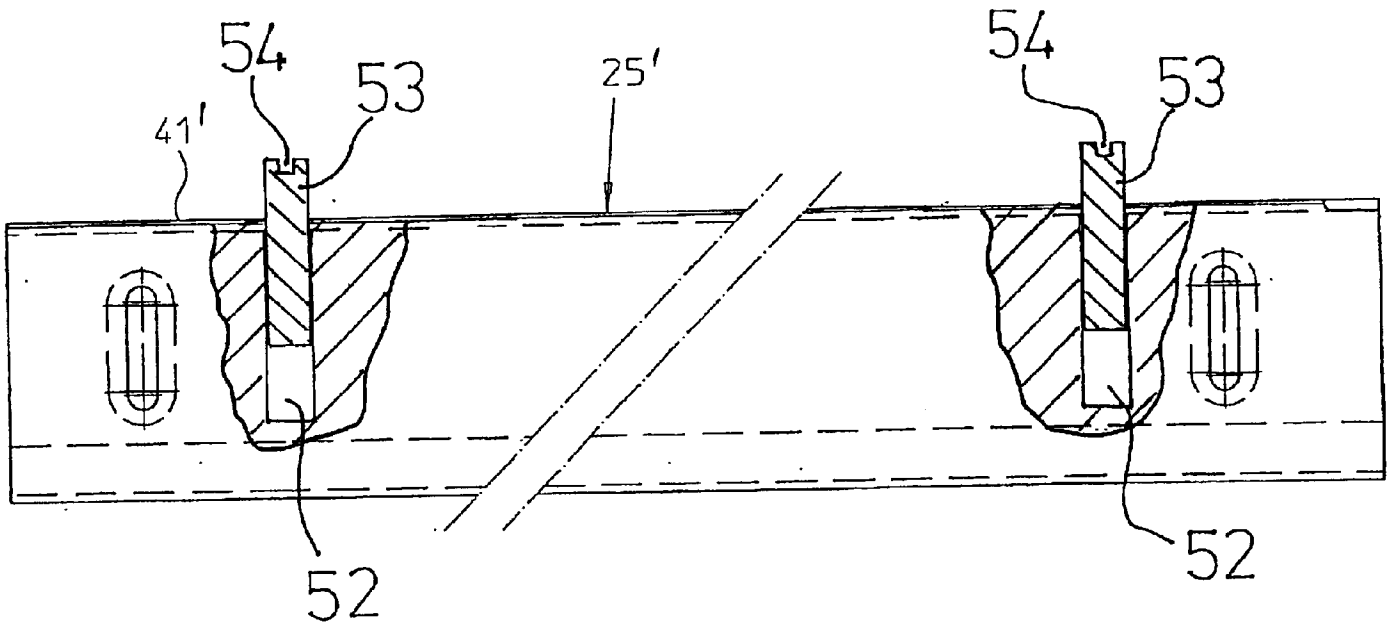
FIG. 4 is a top view of another embodiment of a knife support plate according to the present invention.

A simple alternative embodiment of the knife support plate 25' is seen in FIG. 4. Starting from the longitudinal side 41', bores 52 extend transversely of the longitudinal side 41' into the knife support plate 25'. The bores 52 have internal threads.

Threaded bolts 53 provided with an external thread are arranged in the threaded bores 52, wherein the external thread of the threaded bolts interacts with the internal thread of the bores 52. Provided at the head of each threaded bore 53 is a slot 54 or the like which facilitates engagement of a tool for screwing the bolt in and out.

The threaded bolts 53 protrude with their heads beyond the longitudinal side 41' of the knife support plate 25' and form two stop surfaces which correspond to the stop 27 shown in FIG. 2. The projecting length of the threaded bolts 53 beyond the longitudinal side 41' can be adjusted infinitely variably by screwing the threaded bolts 53 in and out. Once the position of the threaded bolts 53 in the knife support plate 25' has been adjusted, the position can be secured, for example, by means of suitable adhesives or by means of counter nuts, not shown.

FIGS. 5 to 8 show another embodiment of the invention, wherein the knife carrier shown in FIGS. 5 to 8 is the same as the knife carrier 19 shown and described in connection with FIG. 2, with the exception of the knife support plate and the stop ledge. Consequently, the same reference numerals are used for the same components and the description provided for FIG. 2 is applicable.

Figure 5:
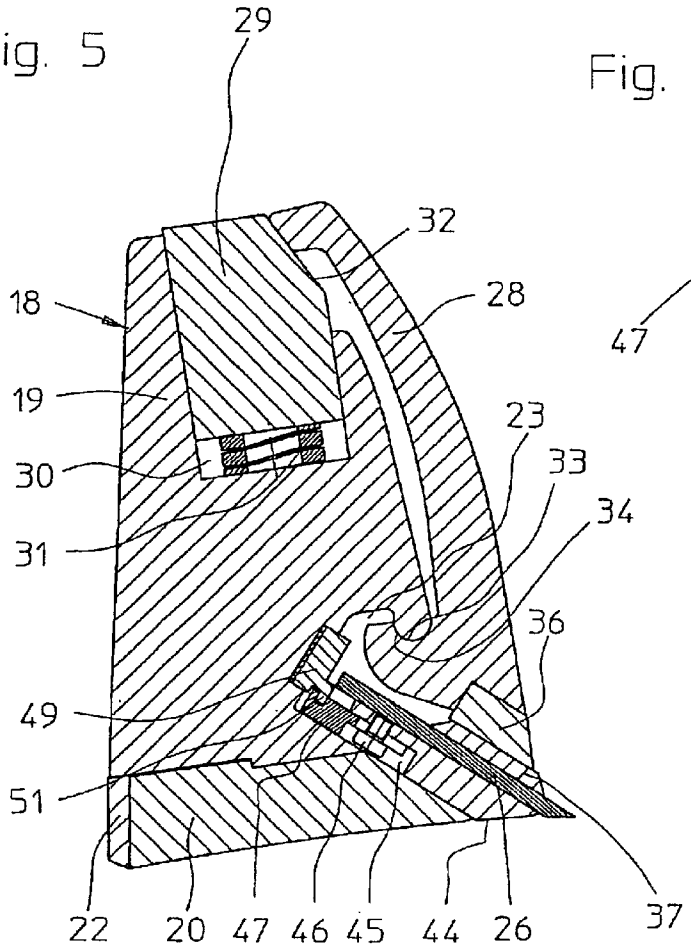
FIG. 5 is a sectional view of an alternative embodiment of the invention.

The solution illustrated in FIG. 5 shows a knife support plate 44 whose rearward longitudinal edge has partially reduced thickness portions, so that rectangular pockets 45 are formed in this manner. The arrangement of the pockets 45 over the length of the knife support plate 44 corresponds, for example, to the arrangement of recesses 42 as shown in FIG. 3*a*. The knife support plate 44 has in the areas of the pockets 45 threaded bores which extend perpendicularly of the upper side thereof, wherein screws 46 engage in the bores.

Figure 7:
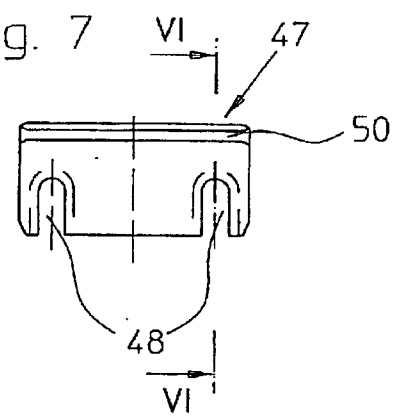
FIG. 6 is a sectional view and FIGS. 7 and 8 are elevational views of a stop plate according to the present invention as used in the embodiment shown in FIG. 5.
Figure 6:
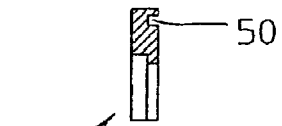
Figure 8:
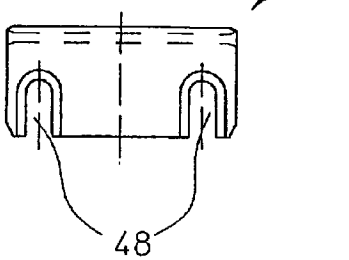

The pockets 45 are intended for receiving a stop plate 47 each, wherein the stop plate 47 is shown in more detail in FIGS. 6, 7 and 8. The stop plate 47 has a thickness which corresponds to the thickness of the pocket 45. As a result, the surface of the stop plate 47 and the surface of the knife support plate 44 are located in one plane after the stop plate 47 has been placed in the pocket 45.

The stop plate 47 has two oblong holes 48 which are open toward a longitudinal edge of the stop plate 47. The oblong holes 48 serve for fastening the stop plate 47 in the pocket 45 by means of the screws 46. The oblong holes 48 with their openings at the edges make it possible that the stop plate 47 can be removed without having to completely separate the screws 46 from the knife support plate 44. The position of the stop plate 47 relative to the knife support plate 44 and, thus, the total width of the knife support plate 44 can be infinitely variably adjusted through the oblong holes 48 and can be secured by tightening the screws 46.

As shown in FIGS. 6, 7 and 8, the edge of the stop plate 47 facing the stop ledge 49 of the knife carrier 18 is provided with a longitudinal groove 50. This groove corresponds to a projection 51 of the stop ledge 49, so that, when the knife bundle 24 is axially inserted, a tooth-like engagement and a simultaneous precision guidance of the knife bundle 24 is obtained, as is clear from FIG. 5. The precision guidance ensures that the knife bundle 24 reaches its predetermined position after it has been inserted into the knife carrier 18. The precision guidance additionally ensures that the knife bundle 24 is secured against radially dropping out in case that the clamping action by the pressure flap 28 is removed.

While specific embodiments of the invention have been shown and described in detail to illustrate the inventive principles, it will be understood that the invention may be embodied otherwise without departing from such principles.

I claim:

1. A device for comminuting material, the device comprising a plurality of knife carriers arranged along a comminuting path, wherein each knife carrier comprises a receiving means with a stop for a knife bundle, wherein the knife bundle is held in a position of operation in the receiving means, wherein each knife bundle is comprised of a knife support plate and a chipping knife, wherein the knife support plate and the chipping knife are connected to each other so as to overlap in a transverse direction in a plane of the knife support plate, and wherein the knife support plate has at a longitudinal side thereof facing the stop of the knife carrier at least one stop surface, and wherein the stop surface is adjustable in the transverse direction of the knife support plate, wherein the stop surface is comprised of at least one stop block braced against the longitudinal side of the knife support plate facing the stop, wherein one or more spacer discs are mounted between the stop block and the longitudinal side.

2. The device according to claim 1, wherein the knife support plate has a recess in an area of the stop block, and wherein the stop block is partially received in the recess.

3. The device according to claim 1, wherein at least one edge of the stop block facing the stop is chamfered.

4. The device according to claim 1, wherein three edges of the support block facing the stop are chamfered.

5. The device according to claim 1, wherein the stop surface and the stop of the knife carrier form a mutual tooth-like engagement permitting relative displacements in the longitudinal direction of the knife carrier.

6. A device for comminuting material, the device comprising a plurality of knife carriers arranged along a comminuting path, wherein each knife carrier comprises a receiving means with a stop for a knife bundle, wherein the knife bundle is held in a position of operation in the receiving means, wherein each knife bundle is comprised of a knife support plate and a chipping knife, wherein the knife support plate and the chipping knife are connected to each other so as to overlap in a transverse direction in a plane of the knife support plate, and wherein the knife support plate has at a longitudinal side thereof facing the stop of the knife carrier at least one stop surface, and wherein the stop surface is adjustable in the transverse direction of the knife support plate, wherein the stop surface is comprised of at least on stop plate arranged over a portion of its dimensions so as to overlap the knife support plate in an overlapping area, and wherein the stop plate is adjustable in the transverse direction with fastening means through oblong holes in one of the knife support plate and the stop plate.

7. The device according to claim 6, wherein the knife support plate and the stop plate have a reduced thickness in the overlapping area.

8. The device according to claim 6, wherein the stop surface and the stop of the knife carrier form a mutual tooth-like engagement permitting relative displacements in the longitudinal direction of the knife carrier.

9. A device for comminuting material, the device comprising a plurality of knife carriers arranged along a comminuting path, wherein each knife carrier comprises a receiving means with a stop for a knife bundle, wherein the knife bundle is held in a position of operation in the receiving means, wherein each knife bundle is comprised of a knife support plate and a chipping knife, wherein the knife support plate and the chipping knife are connected to each other so as to overlap in a transverse direction in a plane of the knife support plate, and wherein the knife support plate has at a longitudinal side thereof facing the stop of the knife carrier at least one stop surface, and wherein the stop surface is adjustable in the transverse direction of the knife support plate, wherein the stop surface and the stop of the knife carrier form a mutual tooth-like engagement permitting relative displacements in the longitudinal direction of the knife carrier.

10. A knife support plate for use in a device for comminuting material, the device including a plurality of knife carriers arranged along a comminuting path, wherein each knife carrier comprises a receiving means with a stop for a knife bundle, wherein the knife bundle is held in a position of operation in the receiving means, wherein each knife bundle is comprised of a knife support plate and a chipping knife, wherein the knife support plate and the chipping knife are connected to each other so as to overlap in a transverse direction in a plane of the knife support plate, the knife support plate comprising at a longitudinal side thereof facing the stop of the knife carrier at least one stop surface, wherein the stop surface is adjustable in the transverse direction of the knife support plate, wherein the stop surface is comprised of at least one stop block braced against the longitudinal side of the knife support plate facing the stop, wherein one or more spacer discs are mounted between the stop block and the longitudinal side.

11. A knife support plate for use in a device for comminuting material, the device including a plurality of knife carriers arranged along a comminuting path, wherein each knife carrier comprises a receiving means with a stop for a knife bundle, wherein the knife bundle is held in a position of operation in the receiving means, wherein each knife bundle is comprised of a knife support plate and a chipping knife, wherein the knife support plate and the chipping knife are connected to each other so as to overlap in a transverse direction in a plane of the knife support plate, the knife support plate comprising at a longitudinal side thereof facing the stop of the knife carrier at least one stop surface, wherein the stop surface is adjustable in the transverse direction of the knife support plate, wherein the stop surface is comprised of at least on stop plate arranged over a portion of its dimensions so as to overlap the knife support plate in an overlapping area, and wherein the stop plate is adjustable in the transverse direction with fastening means through oblong holes in one of the knife support plate and the stop plate.

* * * * *